United States Patent [19]

Pedrazzini

[11] Patent Number: 4,808,244

[45] Date of Patent: Feb. 28, 1989

[54] COMPOSITIONS FOR PROTECTING STEEL SURFACES AGAINST ATMOSPHERIC OXIDATION

[75] Inventor: Giuseppe Pedrazzini, Segrate, Italy

[73] Assignee: ITALBONDER Spa, Caleppio de Settala, Italy

[21] Appl. No.: 98,881

[22] Filed: Sep. 21, 1987

[30] Foreign Application Priority Data

Jul. 10, 1987 [IT] Italy ..... 21242 A/87

[51] Int. Cl.[4] ..... C23C 22/12

[52] U.S. Cl. ..... 148/6.15 Z

[58] Field of Search ..... 148/6.15 Z

[56] References Cited

U.S. PATENT DOCUMENTS

| | | | |
|---|---|---|---|
| 2,493,327 | 1/1950 | Vance | 148/6.15 Z |
| 4,293,349 | 10/1981 | Pedrazzini | 148/6.15 Z |
| 4,670,066 | 6/1987 | Schapins | 148/6.15 Z |

FOREIGN PATENT DOCUMENTS

| | | | |
|---|---|---|---|
| 672797 | 10/1963 | Canada | 148/6.15 Z |
| 1387033 | 12/1964 | France | 148/6.15 Z |
| 0673668 | 7/1979 | U.S.S.R. | 148/6.15 Z |

*Primary Examiner*—Sam Silverbert

*Attorney, Agent, or Firm*—Stevens, Davis, Miller & Mosher

[57] ABSTRACT

Compositions for protecting steel surfaces against atmosferic oxidation comprising the quercitine derivative of monogallerylellogic acid, phosphoric acid, monoacid Zn phosphate, Zn nitrate, ascorbic acid, a water-miscible organic solvent ed water, said water-miscible organic solvent consisting of isopropyl glucol and ethoxypropanol.

Said compositions are applied directly to the oxidized, treated or non-treated, steel surfaces.

2 Claims, 1 Drawing Sheet

COMPOSITIONS FOR PROTECTING STEEL SURFACES AGAINST ATMOSPHERIC OXIDATION

Figure 1:
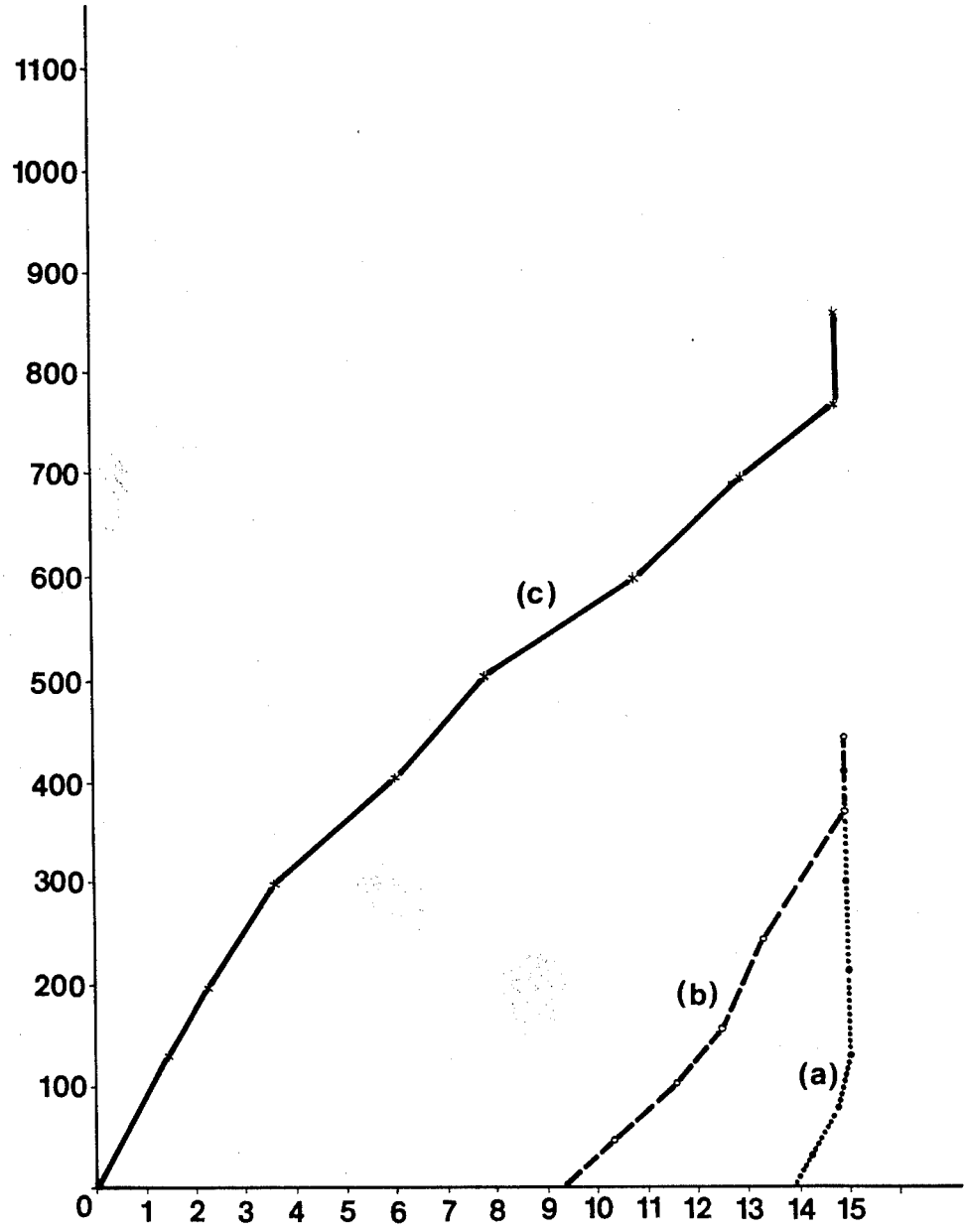

This invention relates to new compositions for protecting steel surfaces against atmospheric oxidation.

The invention also relates to steel objects having a protective layer formed from a said composition as an external layer or as an intermediate layer below the paint, and to the process for protecting steel from atmospheric corrosion by applying a layer of said composition.

Various known processes are currently used for protecting steel surfaces from atmospheric corrosion and, in the case of painted metal surfaces, for preventing oxidation of the metal surface causing the separation and rapid flaking of the overlying paint layer.

The process most widely used and which has given best results in this field up to the present time is undoubtedly the phosphating process. This process consists essentially of treating steel surfaces, whether oxidised or not, with aqueous solutions containing phosphoric acid. The phosphoric acid attacks the iron to form Fe phosphates. Whereas primary iron phosphate is soluble and secondary iron phosphate is slightly soluble, tertiary iron phosphate is totally insoluble. The main purpose of phosphating is therefore to form a surface layer of insoluble tertiary iron phosphate, which protects the underlying metal from any further attack by atmospheric agents.

In practice, during reaction by the phosphating solution, the pH rises because of the reduction in the concentration of hydrogen ions in the boundary layer, and consequently the insoluble tertiary phosphates precipitate.

The phosphate layer formed in the reaction between the phosphating solution and the steel closely adheres to the treated surface, and is characterised by strong resistance to electronic conduction so that it protects the underlying metal from further oxidation processes and prevents incoherence and flaking of pre-existing corrosion products.

The phosphating solutions utilised are rather complicated in that in addition to phosphoric acid and possibly phosphates, they comprise surface-active agents, accelerators, inhibitors of acid attack against zerovalent metal, solvents, antioxidants etc. Said phosphating solutions can be applied to any type of object.

The critical aspect of the phosphating process is the concentration of the phosphoric acid in the phosphating solution. In this respect, if the phosphoric acid is not completely consumed by its reaction with the oxides present on the treated surface and by the surface reaction with the iron, it produces, even if present in small concentrations, a strongly acid reaction against the subsequently applied layers such as oil, wax or paint, and consequently can result in negative reactions in these layers and in the finishing layer which alter and disintegrate them.

As it is very difficult to exactly calculate the quantity of phosphoric acid required, and as an acid deficiency leads to an unsatisfactory phosphated layer, an acid excess is generally used and the phosphated object is then washed with abundant water before applying the finishing layers.

This procedure is however not free from drawbacks in that the protective layer of tertiary iron phosphates is very thin, and does not properly withstand the water washing action, to give rise to the formation of new incoherent oxide by hydrolysis.

To obviate the drawbacks and limitations of phosphating, steel surface treatments have been in force for some years using formulations based on tannic acid derivatives of very high molecular weight which instead of eliminating the rust existing on these steel surfaces, form a continuous covering film over the rust.

This film consists of the product of the reaction between the tannic acids and the iron, and is in the form of a chelate of variable composition bonded to the support.

The drawbacks of this type of surface protection derive mainly from the fact that if an iron oxide layer is present on the steel surface it remains incorporated between the support and the protective layer without being eliminated, and this can lead to separation of the chelate layer by virtue mainly of its different coefficient of anisotropic expansion with respect to the support and the protective layer.

Moreover, under cover of the organic coating, the interchange reaction $Fe^{++} \rightleftarrows Fe^{+++}$ in the underlying layer of uneliminated Fe oxides continues, with consequent variation in the composition of the oxide layer. This results overall in system instability, creating stresses which affect the organic chelate layer and produce discontinuity.

Difficulties are also encountered in this process because of the pH of the applied formulations based on tannic acid, this pH often being insufficiently low to produce a significant initial rate of reaction.

In accordance with the present invention we have now found a new composition for protecting oxidised, treated or non-treated surfaces which has none of the drawbacks of compositions of the known art, and moreover ensures a higher degree of protection, is very stable during storage and is absolutely free of toxic components.

The process for protecting steel surfaces according to the present invention is characterised by the use of mixed inorganic/organic compositions in which each component performs a specific function and is present in a quantity which is critical for system equilibrium. If the components are used outside the critical limits or if unscheduled components are added, the system becomes blocked and loses is functionality.

The compositions according to the invention are characterised by comprising:

the quercetin derivative of monogalloylellagic acid
phosphoric acid
monoacid Zn phosphate
Zn nitrate
ascorbic acid
a water-miscible organic solvent consisting of isopropyl alcohol, propylene glycol and ethoxypropanol water.

The possibility of forming such a mixed system for protecting steel surfaces was unpredictable beforehand because as the organic component is an ester, it is sensitive to the hydrolysing action of phosphoric acid.

In practice, the hydrolysing and thus deactivating action of the phosphoric acid occurs only if the system deviates from the limits defined for its equilibrium.

Furthermore, in said composition the phosphating components as described hereinafter are present in proportions which are ineffective for the phosphating process, and also the organic component is absolutely ineffective if used alone, because of its low molecular weight. It was therefore in no way predictable that said composition could provide an anticorrosive action far superior to that obtainable by phosphating or by known tannin treatment.

The new compositions according to the invention act both by attacking any iron oxides present on the steel surface, and by forming a protective surface layer of organometallic chelate.

The final protective layer consists mainly of the organic coordination layer. In applying said compositions, there is however no cause for preoccupation that the layer may not be absolutely continuous, in that any discontinuity regions are protected by the underlying phosphate layer, consisting of tertiary Zn, Fe and Fe/Zn phosphates in various proportions.

The purpose of the organic solvents, by dissolving the organic component but not the inorganic salts, is to protect the organic components from prolonged contact with phosphoric acid during storage of the formulations. When applying them, they in no way hinder the formation of a perfectly homogeneous, uniformly applicable system, because of their perfect and complete miscibility with water. They also eliminate heterogeneous substances such as fats, oils, workshop dust and the like from the surface to be treated, provided they are present in limited quantities.

The aforelisted components are present in the new compositions in quantities within the critical limits specified hereinafter. The percentages are by weight of the total weight of the composition, organic solvents and water included:

The quercetin derivative of monogalloylellagic acid is present in the composition in a quantity of between 15 and 30%. A quantity of less than 15% leads to a final incoherent layer, whereas a quantity exceeding 30% makes the stability of the composition in solution questionable.

The phosphoric acid is present in a quantity of between 2 and 3.2%; the $Zn(HPO_4)_2$ in a quantity of between 1.1 and 2%; and the $Zn(NO_3)_2$ in a quantity of between 7 and 12%. Any deficiency in one of these three latter components results in a lower initial reaction rate and the formation of a final incoherent protective layer. Any excess in one or more of said components excessively slows down the various competing processes for the formation of the protective layer, and thus slows down overall the formation of the protective layer on the treated surface.

The ascorbic acid is present in the composition in a quantity of between 0.05 and 0.5%. The minimum indicated limit corresponds to the minimum necessary for acting as an accelerator for the layer formation process. Any excess beyond 0.5% is of no advantage, and in fact can be damaging in that it begins to interfere with the other components.

The organic solvent as heretofore defined is a mixture of solvents, in which each component has a specific purpose. Said mixture consists of isopropyl alcohol the main purpose of which is to degrease the metal surface, propylene glycol which retards the drying of the layer and thus favours uniformity, and ethoxypropanol which has a considerable solvent power for said quercetin derivative and therefore protects it within certain limits from the aqueous acid phase. In total, the organic solvent constitutes between 18 and 32% of the composition, and its individual components are distributed in the following manner: isopropyl alcohol 5–15%, propylene glycol 5–15%, ethoxypropanol 2–8% of the composition. Water and the quercetin derivative are added to the total of the stated organic solvent in its indicated percentages, to arrive at 100%. In this manner, a homogeneous solution is obtained.

The compositions according to the present invention can be prepared in various ways, all suitable for the purpose.

The following series of steps has given positive results, and is indicated by way of example only:

preparation of a premix consisting of a solution of the phosphoric acid, Zn phosphate and Zn nitrate in water addition of the monogalloylellagic acid quercetin derivative under agitation to the uniform premix obtained in this manner addition of the organic solvents to the obtained aqueous solution, addition of the ascorbic acid and finally addition of the water necessary to obtain the required composition.

The composition according to the present invention can be applied to steel surfaces by any procedure of the known art, such as by spraying, immersion or manually.

This enables the new antirust process to be used for any type of object whether of large dimensions such as ships in shipyards, gasholders, tanks, reaction columns and the like, and of small dimensions such as automobile body components.

The compositions are applied at ambient temperature, preferably between 15° C. and 30° C., in layers of variable thickness depending on the state of the steel surface.

Generally, 3–5 micron layers are sufficient. Under normal conditions, drying is complete and the protective layer stable after about 24 hours. It is preferable however to wait at least 48 hours before applying any subsequent layers.

The mixed organic-inorganic antirust layers obtained according to the present invention have proved compatible with any finishing layer applied to them, and in particular with any type of paint. They ensure electrical insulation of the metal surfaces, perfect bonding of subsequent finishing layers and particularly of paint, and a considerable increase in the corrosion resistance of the object.

In order to demonstrate the technical progress made in the field of anticorrosive coatings by the compositions according to the invention, comparative tests were carried out with other types of metal surface pretreatment, applied before final covering with large-thickness paint layers.

The accompanying FIG. 1 shows the test results obtained according to the type of pretreatment.

Specifically, the FIGURE comprises three curves, of which curve (a) relates to a steel test piece without pretreatment, curve (b) relates to a steel test piece pretreated with a known commercial phosphating agent (Gabrol C2 of Italbonder, Milan) and curve (c) relates to a steel test piece pretreated with an antioxidant according to the present invention, having the following composition:

| | |
|---|---|
| phosphoric acid | 2.5% by weight |
| Zn phosphate | 1.5% by weight |
| Zn nitrate | 11.0% by weight |
| quercetin derivative of a monogalloylellagic acid | 22.0% by weight |
| isopropyl alcohol, propylene glycol, ethoxypropanol | 25.0% by weight |
| ascorbic acid | 0.2% by weight |

-continued

| | |
|---|---|
| water | 37.8% by weight |

In all cases the steel test pieces, of dimensions 10.5×19.5 cm, were covered with a final paint layer using a ship painting procedure, and were then subjected to a resistance test in a corrosion chamber in accordance with the ASTM B 117-64 procedure.

In the FIGURE, the abscissa represents the Schüster-Krause reading and the ordinate represents time in hours.

As can be seen from the FIGURE diagrams, phosphating treatment considerably improves the corrosion resistance of the steel, but the results obtained with the new treatment according to the invention are much better.

Further tests were carried out on the shelf life of the composition according to the invention used for the aforesaid tests, in comparison with the following composition:

| | |
|---|---|
| phosphoric acid + Zn phosphate + Zn nitrate | 25.5% |
| tannin extract | 22.3% |
| $CH_2O$ | 2.0% |
| isopropanol | 10.5% |
| ethylene glycol | 10.5% |
| butyl cellosolve | 2.5% |
| cellosolve | 1.5% |
| water | 24.2% |

Samples of the two compositions were kept standing at ambient temperature for 80 hours. The amount of bottom sediment was 4% in the case of the composition according to the invention against 8% for the comparison composition.

In another test, samples of the two compositions were centrifuged at 1500 r.p.m. for 15 minutes. The bottom sediment was 2.5% in the case of the composition according to the invention, against 5% for the comparison composition.

I claim:

1. Compositions for protecting steel surfaces against atmospheric oxidation, consisting essentially of the quercetin derivatives of monogalloyllellagic acid, contained in a quantity of between 15 and 30% by weight, phosphoric acid contained in a quantity of between 2 and 3.2% by weight, monoacid Zn phosphate contained in a quantity of between 1.1 and 2% by weight, Zn nitrate contained in a quantity of between 7 and 12% by weight, ascorbic acid contained in a quantity of between 0.05 and 0.5% by weight, an organic solvent mixture consisting of isopropyl alcohol, propylene glycol and ethoxypropanol, contained in a quantity of between 18% and 32% by weight, and water.

2. Compositions as claimed in claim 1, characterised in that the isopropyl alcohol is present in a quantity of between 5 and 15% by weight, the propylene glycol is present in a quantity of between 5 and 15% by weight, and the ethoxypropanol is present in a quantity of between 2 and 8% by weight of the composition.

* * * * *